US005235830A

United States Patent [19]

Benge

[11] Patent Number: 5,235,830

[45] Date of Patent: Aug. 17, 1993

[54] LOCKING DEVICE FOR OPENABLE CONTAINERS

[76] Inventor: James A. Benge, 3321 Piney Point, Jacksonville, Tex. 75766

[21] Appl. No.: 932,805

[22] Filed: Aug. 20, 1992

[51] Int. Cl.[5] ..... E05B 65/52

[52] U.S. Cl. ..... 70/56; 70/71; 70/159; 292/31; 292/148; 292/162; 292/341.15

[58] Field of Search ..... 70/54–56, 70/71, 159; 292/341.15, 24, 31, 148, 156, 162, DIG. 68

[56] References Cited

U.S. PATENT DOCUMENTS

| | | | |
|---|---|---|---|
| 1,025,430 | 5/1912 | Sundee | 292/162 |
| 1,370,941 | 3/1921 | Binkley | 70/71 X |
| 2,777,315 | 1/1957 | Burke | 292/341.15 |
| 2,912,271 | 11/1959 | Schaefer | 292/DIG. 68 X |
| 2,936,189 | 5/1960 | Pearson | 292/31 X |
| 3,334,933 | 8/1967 | Ehlers | 292/148 |
| 4,290,281 | 9/1981 | Knaack et al. | 70/63 X |
| 4,998,425 | 3/1991 | Hoogland | 70/159 |

FOREIGN PATENT DOCUMENTS

| | | | |
|---|---|---|---|
| 4292 | of 1883 | United Kingdom | 292/162 |
| 2058196 | 4/1981 | United Kingdom | 70/56 |

*Primary Examiner*—Lloyd A. Gall
*Attorney, Agent, or Firm*—Timmons & Kelly

[57] ABSTRACT

A locking device for a storage container such as a tool box in which a hinged lid includes a pair of spaced detents depending to a latching configuration at their distal ends. Cooperating with the detents is a tubular conduit slidably displaceable and including slots in an upper surface in which to receive and secure the distal ends of the detents. A padlock for unlocking the box is received within a recess of the tool box providing exterior exposure to only the key end of the lock. Opening the padlock causes the lock body to eject partially outward of the tool box while forming a gap between the latching end of the lock shackle and the lock body. Secured to the conduit in the plane of the gap is a manually displaceable wing which when the lock is opened can be displaced into the gap to in turn displace the conduit and enable release of the detents.

13 Claims, 3 Drawing Sheets

FIG. 1
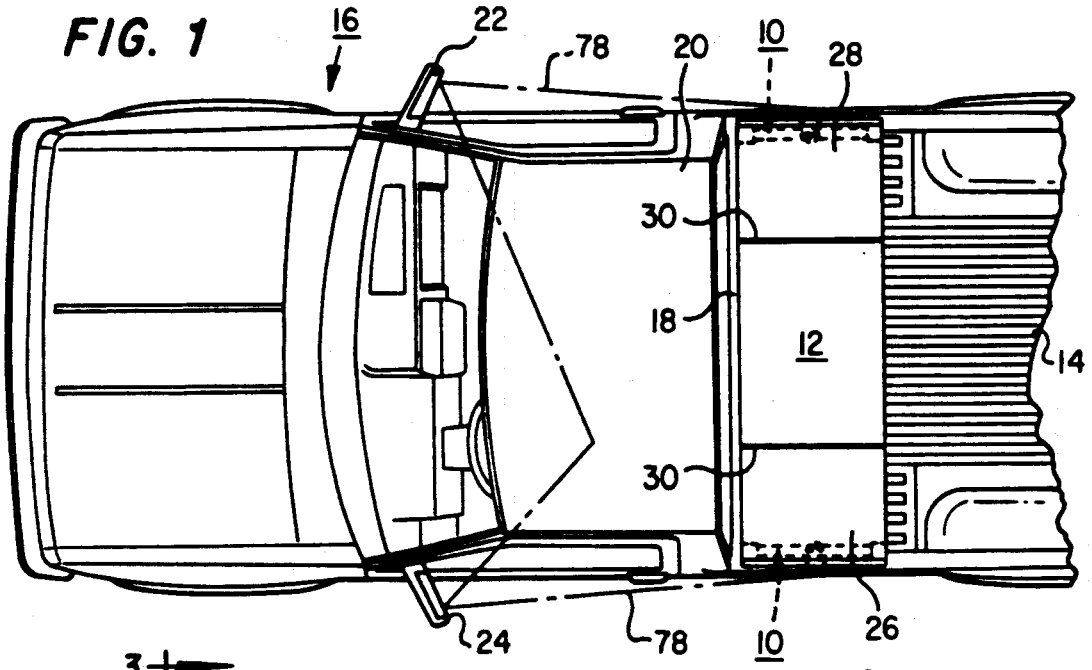
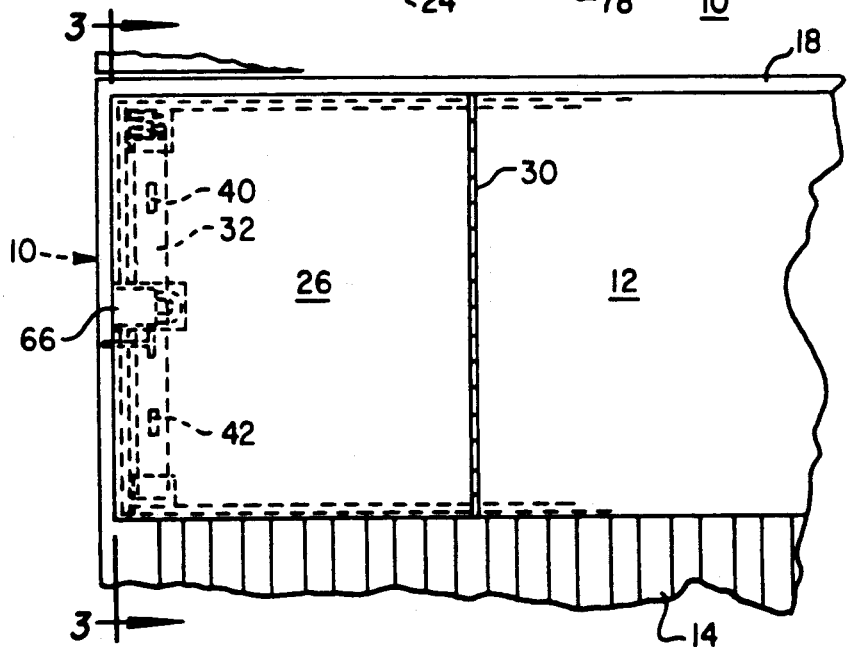
FIG. 2
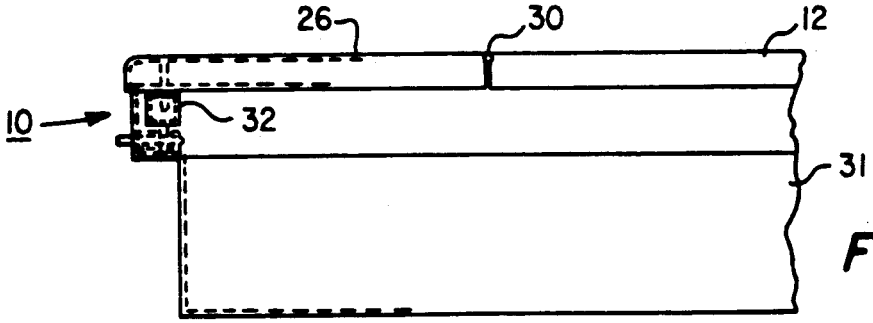
FIG. 4

LOCKING DEVICE FOR OPENABLE CONTAINERS

FIELD OF THE INVENTION

The field of art to which the invention relates comprises the art of locking devices for storage containers such as a tool box utilized for securing work tools and mounted in place on the exposed rear end of a pick-up truck.

BACKGROUND OF THE INVENTION

It is a common practice in the industrial service trades such as appliance repair, plumbing, etc. for the generally smaller and more portable tools to be carried in a tool box secured in the bed area of a pick-up truck. Because such tools are in any event regarded as high theft items, their known presence in a tool box situated in an exposed and unattended pick-up truck tends to invite the potential for theft.

BACKGROUND OF THE PRIOR ART

Because of the high frequency of theft from unattended tool boxes, it is common to provide a lock of sorts by which opening becomes comparatively more difficult than when the box is unlocked. Typically, the lock is either the tumbler or padlock type that secures the box against being opened by other than a forced breakage. Even where the padlock is locked but generally exposed and accessible, it does not normally pose a significant obstacle to an experienced thief At the same time, failure to secure the lock may go unnoticed for prolonged periods of time during which theft can occur. A more secured box is disclosed U.S. Pat. No. 4,290,281 utilizing an internally received padlock that limits accessibility to the lock by exposing only the key end.

OBJECTS OF THE INVENTION

It is an object of the invention to provide a novel locking device for a tool box or other type storage enclosure.

It is a further object of the invention to provide a locking device as in the previous object affording a high order of security against tampering and breakage.

It is a still further object of the invention to provide a locking device as in the previous objects that is particularly suitable for a tool box situated on a pick-up truck whereby the open lock relation can be readily ascertained by the truck driver via side glances to the side view mirrors of the vehicle.

SUMMARY OF THE INVENTION

This invention relates to locking devices for storage containers, such as tool boxes, cabinets, etc. where a high level of security against unauthorized opening is desired. In a preferred embodiment, the invention relates to a security lock for a tool box that may be placed in an exposed relation within the bed area of a pick-up truck.

To effect the foregoing, the lock device in accordance herewith includes a localized walled recess extended inward from an accessible face of the box. A padlock for locking and unlocking the box can be received and retained within the recess with only the key hole end exposed. A post secured internally of the box, extends through the lock shackle and precludes removal of the lock.

The box includes a hinged cover or lid enabling internal access to the box. For securing the cover against unauthorized opening there is provided a tubular member or conduit having a pair of spaced-apart slotted openings in an upper wall. The conduit is slidably supported for displacement beneath the lid within the housing section of the box. Pivotally supported, spring biased latching members vertically depend from the underside of the lid and cooperate with the slots in the conduit for securing the box in its locked relation.

The conduit is spring biased so as to normally remain in its locked relation and secure the latching members when received against release of the lid. Attached at the underside of the conduit is a wing that terminates in a thin distal end normally disposed in a plane just clear of the shackle connection to the padlock. A closed end of the conduit is exposed through an opening in the box to enable its displacement. Alternatively, a finger actuated arm is laterally secured to the wing and extends through a slot to outward of the tool box. At such time as the padlock is opened by a key, the lock body is caused to be ejected partially outward from its retained recess while the shackle remains in place. This causes the conventional gap to occur between the lock body and the latch end of the shackle. During this open relation, the wing via the opening or the alternative arm can be forced laterally into the gap to in turn displaced the conduit and its slots enabling the latch members to be released and the lid to be raised.

Releasing the arm restores the conduit to its normally locked relation for receiving the latch members subsequently when the lid is closed. Being that the padlock of the tool box is situated in an end wall adjacent a side panel of the truck, the driver is enabled to ascertain whether the box is open or locked via sighting in the sideview mirror.

The above noted features and advantages of the invention as well as other superior aspects thereof will be further appreciated by those skilled in the art upon reading the detailed description that follows in conjunction with the drawings.

BRIEF DESCRIPTION OF THE DRAWINGS

FIG. 1 is a plan view of a pick-up truck in which a tool box utilizing the locking device hereof is disposed;

FIG. 2 is an enlarged fragmentary plan view of one end of the tool box of FIG. 1 in its locked relation;

FIG. 4 is a front elevation of the tool box as viewed substantially along the lines 4—4 of FIG. 3;

DESCRIPTION OF THE PREFERRED EMBODIMENT

Figure 3:
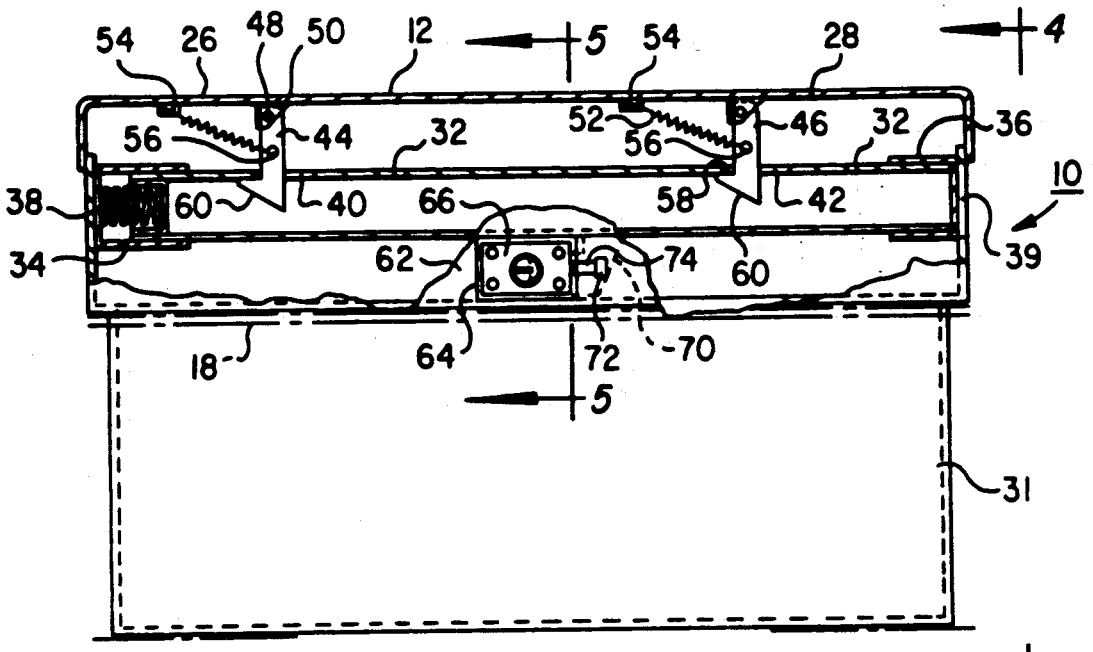
FIG. 3 is an end elevation of the tool box as viewed substantially along the lines 3—3 of FIG. 2.

In the description which follows, like parts are marked throughout the specification and drawings with the same reference numerals respectively. The drawing figures are not necessarily to scale and in certain views, parts may have been exaggerated for purposes of clarity.

Referring now to the drawings, the locking device hereof designated 10 for the preferred embodiment of this invention is embodied in a tool box 12 situated transversely in the bed 14 of a pick-up truck 16. As is typical with pick-up trucks, there is included a rail 18 extending transversely behind the driver's cab 20 and on which the rear edge of the tool box is disposed. The pick-up truck includes sideview mirrors 22 and 24 for sighting the locked and unlocked condition of the tool box as will be explained. For these purposes, tool box 12 includes lids or covers 26 and 28 at opposite ends each hinge connected at 30 for internal access to the box housing 31.

To secure and release lids 26 and/or 28, the locking device hereof includes an elongated tubular conduit 32 slidably supported in opposite end sleeves 34 and 36. Also contained intervening in sleeve 34 is a jacketed coil spring 38 engaging the left end of conduit 32 thereat so as to normally urge the right closed end of the conduit into sleeve 36 opposite box opening 39. Formed in the upper wall of conduit 32 is a pair of spaced elongated slots 42 located so as to receive and cooperate with latching detents 44 and 46 independently secured from the underside of both lids 26 and 28.

Each of the detents is pivoted about a crosspin 48 mounted in a bracket 50 secured to the underside of the lid. It is biased clockwise as shown via a spring 52 tensioned between a connecting bracket 54 and a pin 56 at an intermediate location on the detent. The distal end of the detent is formed in a triangular configuration in which the horizontal ledge 58 is adapted to engage and latch with the interior undersurface of the wall about the slot in conduit 32. This enables the locked position of the lid to be maintained as illustrated in FIG. 3. The underside canted or angled surface 60 enables closure of the lid by engaging the edge of the cooperating slots in the course of penetrating inward of the slots as the lids 26 and 28 are being pivoted toward their closed positions.

In order to secure the closed position of the lids while enabling each lid to separately be released on command, each end wall of the tool box includes an inwardly extending rectangular cove or recess 64 sized to closely fit a suitable padlock 66 when the padlock is in its locked relation. In this arrangement with the padlock in the recess, only the key end of a padlock is exposed exterior of the box. A transverse post 68 secured from internally of the box and extending through the shackle 66 of the padlock prevents withdrawing the padlock in either the locked or unlocked relation as will be understood.

Figure 7:
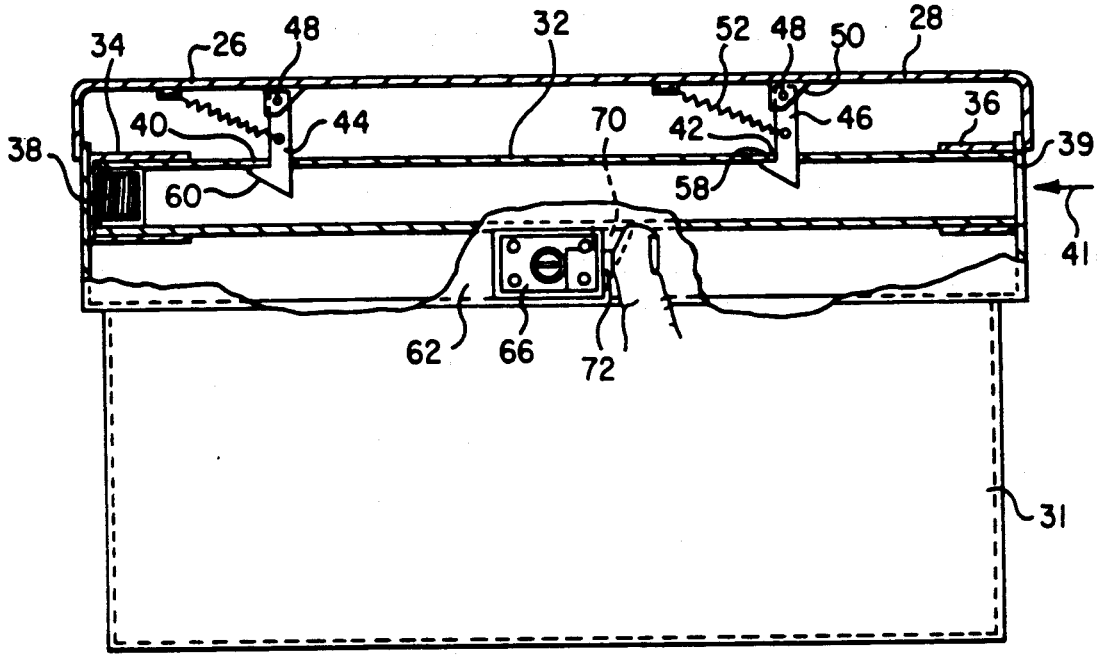
FIG. 7 is a partially sectioned elevation similar to FIG. 3 for operating the release mechanism of the locking device hereof.

For effecting release of the respective lids, an internal wing 70 is secured to the underside of conduit 32 and includes a lip 71 that is normally positioned juxtaposed to the body of lock 66 adjacent the latch connection with shackle 67. Via opening 39, the conduit member can be slidably displaced leftward as represented by arrow 41. Where lateral bar 72 is utilized connected to the wing it extends through a slot 74 to beyond end wall 62. This renders bar 72 accessible for thumb engagement for conduit displacement (see FIG. 7).

Figure 5:
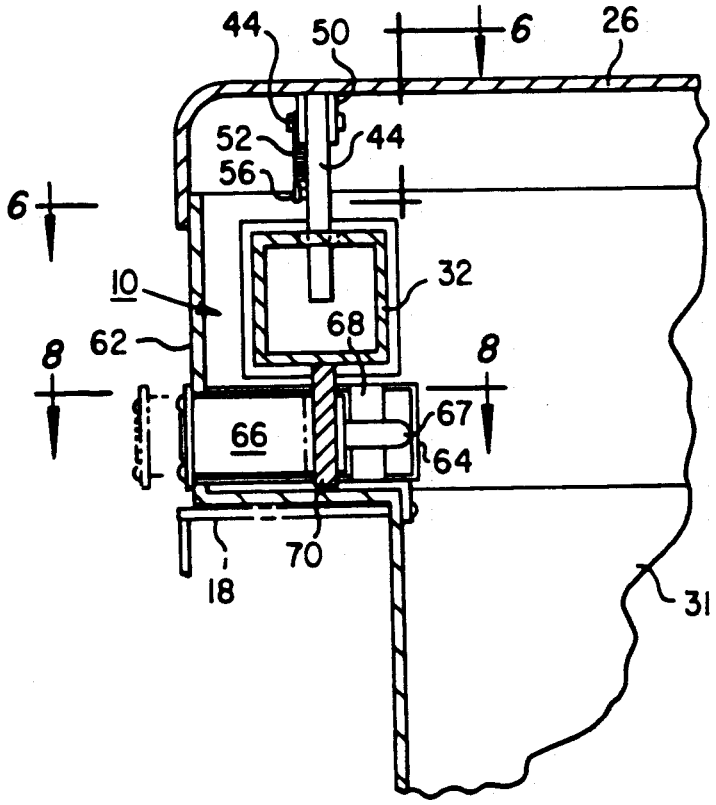
FIG. 5 is a fragmentary sectional elevation as viewed substantially along the lines 5—5 of FIG. 3.
Figure 6:
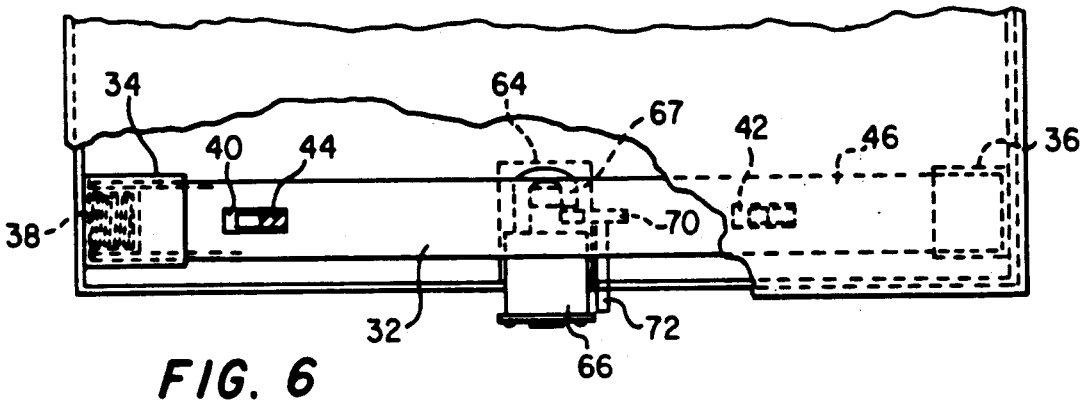
FIG. 6 is an enlarged fragmentary sectional plan view as seen substantially along the lines 6—6 of FIG. 5.
Figure 8:
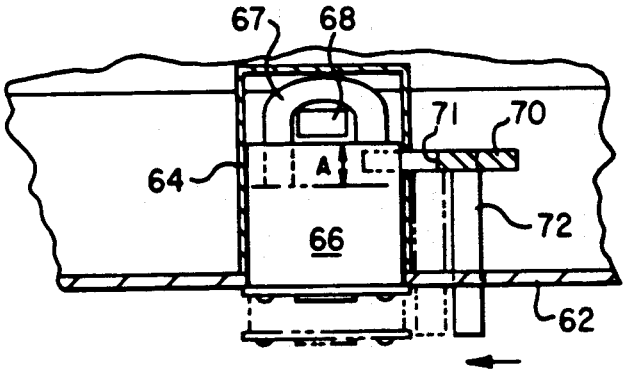
FIG. 8 is a fragmentary sectional view of the open lock relation as viewed substantially from the position 8—8 of FIG. 5.

At such time as either lid is to be released, opening the respective padlock via a key enables the body of the lock to be ejected partially outward beyond and past end wall 62 from the position shown solid to the position shown in phantom in FIGS. 5 and 8. At the same time shackle 67 being secured by post 68 remains secured in position against the end of recess 64. In the course of the lock being opened, a gap designated "A" (FIG. 8) is produced between the latch end of the shackle and the lock body. By displacement of conduit either through opening 39 or via bar 72, wing 70 is caused to slidably enter the gap causing conduit tube 32 to be displaced leftwardly (as illustrated) from the relation shown in FIG. 3 to the relation shown in FIGS. 6 and 7. By displacing the conduit, each of the slots 40 and 42 are likewise displaced so as to clear the distal end of the latching detents 44, 46 and enable the affected lid to be lifted upwardly. Once the detents are clear of the slots, bar 72 can be released enabling spring 38 to restore the conduit to the lock relation of FIG. 3. The body of padlock 66 can then he forced inward of recess 64 until the shackle latches.

As soon as the detents clear the slot openings 40 and 42, they are urged clockwise (as illustrated) by tensioned spring 52. At such time as closure of the lid is to occur, angle edge 60 of each detent will engage the leftmost edge of its respective slot opening in the conduit enabling the detent to be forced into the slot. After completing penetration, upper ledge 58 by action of spring 52 snaps upward to engage the underside of the conduit wall thereat restoring the locked relation of FIG. 3. By virtue of the pop out effect of the padlock with respect to recess 64, the open relation of either padlock can be readily ascertained by a driver of the truck via the sight lines 78 extending from sideview mirrors 22 and 24.

By the above description, there is disclosed a novel locking device for openable containers by which controlled access is provided to enable container opening. In that only the key end of the lock is normally exposed, the remaining components of the device are completely secured and concealed from about the exterior of the container. Whereas a tool box has been described for use in a pick-up truck as the preferred application of the locking device hereof, it will be appreciated that the invention can be readily adapted to any number of similar type containers or enclosures for whatever ultimate purpose the user has in mind. Likewise, whereas a walled conduit 36 has been described, it should be apparent that a member having a channel, plate cross section or other suitable configuration could be readily substituted.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A locking device for an enclosed tool box having a lid/door providing for closable access to the interior of said tool box and a recess defined in a wall thereof, said locking device comprising:

a plurality of longitudinally spaced elongated detents secured from an interior face of said lid/door and extending to a distal end having a latching configuration;

an elongated tubular member interior of said tool box having slots in which to receive the distal end of said detents in a latching relation to within the interior open tube passage thereof; said member being supported for slidable displacement from a first position latching said detents against removal and a second position in which said detents are released for removal to enable said lid/door to be opened;

a padlock having a key end and secured in said recess in a manner generally limiting exterior access of said padlock to said key end and operable from the exterior of said tool box between a locked and unlocked relation;

a wing secured to said member for displacement therewith between said positions when said padlock is in its unlocked relation and prevented therewith against displacement when said padlock is in said locked relation; and displacement means accessible from the exterior of said tool box enabling manual displacement of said member with said wing between said first and second positions when said padlock is in its unlocked relation.

2. A locking device in accordance with claim 1 including biasing means urging said member toward said first position.

3. A locking device in accordance with claim 2 in which said biasing means opposes displacement of said member and said wing by said displacement means from said first to said second position and acts to restore said member and said wing from said second position to said first position when said displacement means is released.

4. A locking device in accordance with claim 3 in which said padlock includes a body having said key end and a shackle having a latch end cooperating with said body to latch therewith when said padlock is in said locked relation and to unlatch and relatively displace from said body when said padlock is in said unlocked relation to define a predetermined gap between the latch end of said shackle and said body and said wing is positioned for displacement in a plane transversely extending through the gap of the unlatched padlock.

5. A locking device in accordance with claim 4 in which said recess closely confines said padlock and there is included means to secure the shackle against displacement when said padlock is unlatched so as to cause said body to be displaced for effecting said predetermined gap.

6. A locking device in accordance with claim 5 in which said recess is sized to substantially receive and limit access to said padlock in its locked relation to only the key end of said padlock body while enabling said key end to be ejected partially outward of said recess when said padlock is caused to unlatch.

7. A locking device in accordance with claim 6 in which said member includes separate slots in which to receive each of the respective detents, there is included spring means to arcuately displace said detents when released from said slots and each of said detents is angled at its distal end to penetrate and interlock within a respective slot of said member when said lid/door is closed.

8. A locking device in accordance with claim 7 in which said partially ejected padlock enables exterior sight recognition of the unlocked relation of the padlock.

9. A locking device in accordance with claim 8 in which said tool box is adapted for secured placement in the bed behind the cab of a pick-up truck, the pick-up truck has a side view mirror at least on the driver's side of the cab and the locked and unlocked relation of said padlock can be seen by the truck driver in a sighting through said side view mirror.

10. A locking device in accordance with claim 9 in which said tool box includes a lid/door at both ends of the box each having a said locking device, said pick-up truck includes a second sideview mirror at the passenger side of the truck and the locked and unlocked relations of the padlock can be seen on both the driver and passenger sides by a driver viewing into both sideview mirrors.

11. In a tool box having a hinged lid providing for closable access to the interior of said box and a recess defined in a wall thereof, a locking device comprising:

a plurality of longitudinally spaced detents secured from an interior face of said lid and extending to a distal end having a latching configuration;

an elongated tubular member interior of said box having slots in which to receive the distal end of said detents in a latching relation to within the interior open tube passage thereof, said member being supported for slidable displacement from a first position latching said detents against removal and a second position in which said detents are released for removal to enable said lid to be opened;

a padlock having a key end and secured in said recess in a manner generally limiting exterior access of said padlock to said key end and operable from exterior of said tool box between a locked and unlocked relation;

a wing secured to said member for displacement therewith between said positions when said padlock is in its unlocked relation and prevented therewith against displacement when said padlock is in said locked relation; and displacement means accessible from the exterior of said tool box enabling manual displacement of said member with said wing between said first and second positions when said padlock in is its unlocked relation.

12. In a tool box in accordance with claim 11 in which said displacement means comprises an opening in a wide of said tool box opposite an end of said member, and affording manual displacement access to said member.

13. In a tool box in accordance with claim 11 in which said displacement means comprises a bar secured to said wing and extending laterally therefrom through a slot in a wall of said box to a distal end outward of said box.

* * * * *